US005873515A

United States Patent [19]

Dunn et al.

[11] Patent Number: 5,873,515

[45] Date of Patent: Feb. 23, 1999

[54] CARTON WITH TEAR CONTROL HANDLE

[75] Inventors: Jackie Wayne Dunn, West Monroe; Jerry Franklin Wilson, Downsville, both of La.

[73] Assignee: Riverwood International Corporation, Atlanta, Ga.

[21] Appl. No.: 102,979

[22] Filed: Jun. 23, 1998

[51] Int. Cl.[6] ..... B65D 5/468

[52] U.S. Cl. ..... 229/117.13; 229/117.14; 229/920

[58] Field of Search ..... 229/103.2, 117.13, 229/117.14, 198.2, 920; 206/141, 427

[56] References Cited

U.S. PATENT DOCUMENTS

| | | | |
|---|---|---|---|
| 4,463,852 | 8/1984 | Stone | 206/427 |
| 4,577,799 | 3/1986 | Oliff | 229/117.13 |
| 5,131,588 | 7/1992 | Oliff | 229/198.2 |
| 5,379,944 | 1/1995 | Stout et al. | 229/920 |
| 5,480,091 | 1/1996 | Stout | 229/117.14 |
| 5,639,017 | 6/1997 | Fogle | 229/117.14 |

*Primary Examiner*—Gary E. Elkins

[57] ABSTRACT

A carton including a bottom panel and first and second opposite side panels each connected to the bottom panel. The carton further includes first and second end panels connected to the bottom panel and a top connected to the side panels. The top includes a multi-ply handle section flanked by opposite single-ply sections, with the top being foldably connected to the first and second sides and extending from the first to the second end. The top includes first and second hand openings which define a central hand grip. Furthermore, the top includes four tear control cuts extending outwardly away from adjacent the central hand grip. The tear control cuts are each J-shaped and lead away from the multi-ply section. The J-shaped tear control cuts each include a shank portion and a hook portion and the hook portions each point away from the multi-ply handle section. Also, the shank portions are each substantially aligned with a corner of the top. This construction allows the carton to be made from thinner paperboard while still providing adequate strength.

14 Claims, 4 Drawing Sheets

CARTON WITH TEAR CONTROL HANDLE

TECHNICAL FIELD

The present invention relates to an article carrier and more particularly relates to a carton having an integral handle with tear control elements.

BACKGROUND OF THE INVENTION

Cartons are often provided with a handle for convenient lifting and carrying. A satisfactory handle should be designed to be readily grasped, comfortable to the hand, and capable of lifting the carton without tearing. For cartons containing heavy loads, it has been common to reinforce the handle by making it of two-ply construction. For example, in fully enclosed sleeve-type cartons, the top panel often is formed by overlapping top panel flaps located at the ends of a blank. Each flap contains a handle opening arranged so that the top panel of the carton includes two spaced openings. This arrangement is sometimes referred to as a "suitcase handle" since the strap portion of the top panel between the handle openings is gripped in the manner of a suitcase handle. An example of such a suitcase handle can be found in the carton disclosed in U.S. Pat. No. 5,333,734.

U.S. Pat. No. 2,955,739 of Collura describes a handle carton in which a two-ply handle is attached to the end flaps of a carton and is positioned above the top panel of the carton. The two-ply handle is formed along the edge of the carton blank by folding and adhering one handle strip against another. The two-ply handle is then folded yet again in a "Z" fashion, causing the handle to be separated from the top panel of the carton, while still remaining attached to the end flaps.

One problem associated with cartons having handles is that uncontrolled tearing can tear across the handle itself, compromising or completely destroying the handle's ability to carry the carton. It has been known in the prior art to, in some instances, provide pre-existing cuts in a carton to control how tearing takes place. In the context of a single-ply top designed to have a punch-through hand opening, U.S. Pat. No. 4,684,059 discloses the use of control elements (including J-shaped cuts) to control the direction of tearing in the top. The J-cut portions are designed to inhibit tearing of the top panel in a direction toward the ends of the carton and to direct the tearing to the sides of the carton. In addition to J-shaped cuts, the '059 patent also discloses tear control cuts which are generally C-shaped.

At present, the common practice of the packaging industry to prevent tearing of the handle in a carton is to make the entire carton out of sufficiently heavy (thick) paperboard to provide sufficient strength for the (typically) 2-ply handle extending from one end of the carton to the other. While this provides satisfactory strength, it does so at the expense of requiring needlessly high cost paperboard for the entire carton.

Accordingly, it can be seen that a need yet remains for a carton which includes a handle which resists tearing and yet which can be made from thinner paperboard to save costs. It is to the provision of such a carton that the present invention is primarily directed.

SUMMARY OF THE INVENTION

Briefly described, in a preferred form the present invention comprises a carton including a bottom panel and first and second opposite side panels each connected to the bottom panel. The carton further includes first and second end panels connected to the bottom panel and a top connected to the side panels. The top includes a multi-ply handle section, with the top being foldably connected to the first and second sides and extending from the first end to the second end. The top includes first and second hand openings which define a central hand grip. Furthermore, the top includes a plurality of tear control cuts extending outwardly away from adjacent the central hand grip.

Preferably, the tear control cuts are each J-shaped and lead away from the multi-ply section. Also preferably, the J-shaped tear control cuts each include a shank portion and a hook portion and the shank portions each point away from the multi-ply section. Also preferably, the shank portions are each substantially aligned with a corner of the top.

Preferably, the top includes diagonal score lines for defining lateral gussets and the diagonal score lines are generally aligned with the tear control cuts. Also preferably, the top includes secondary oblique score lines extending from the multi-ply section to the diagonal score lines.

Moreover, the tear control cuts preferably extend substantially diagonally outwardly away from the central hand grip portion toward corners of the top. Alternatively, the tear control cuts include a first portion which extends substantially diagonally outwardly away from the central hand grip and a second portion which also extends generally toward a corner of the top. In this alternate form, the top preferably further includes diagonal score lines extending from adjacent the first portion to corners of the top and secondary score lines extending from adjacent the second portion to the corners of the top.

A carton according to the present invention has a great advantage over the known prior art cartons in that the carton can be provided with sufficient strength for containing and carrying heavy articles therein (such as beverage cans or bottles), while at the same time reducing the thickness of the paperboard (thereby reducing the cost inasmuch as a substantial portion of the cost of such a carton is the cost of the paperboard and the cost of paperboard is directly proportional to its thickness). By closely controlling how the tearing occurs in the top, one can effectively strengthen the handle for a given paperboard thickness. It is this strengthening of the handle which allows the thickness of the paperboard to be reduced in the entire carton. For example, where the paperboard of a commercial carton had been 0.021" according to a prior art design, the thickness of the paperboard according to the present invention can be reduced to 0.018". This represents a very substantial cost savings.

Accordingly, it is an object of the present invention to provide a carton which is inexpensive to manufacture and yet which provides adequate strength.

It is another object of the present invention to provide a carton having good strength, while allowing the thickness of the paperboard to be reduced.

It is another object of the present invention to provide a carton in which tearing in the top is tightly controlled to effectively strengthen the handle.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
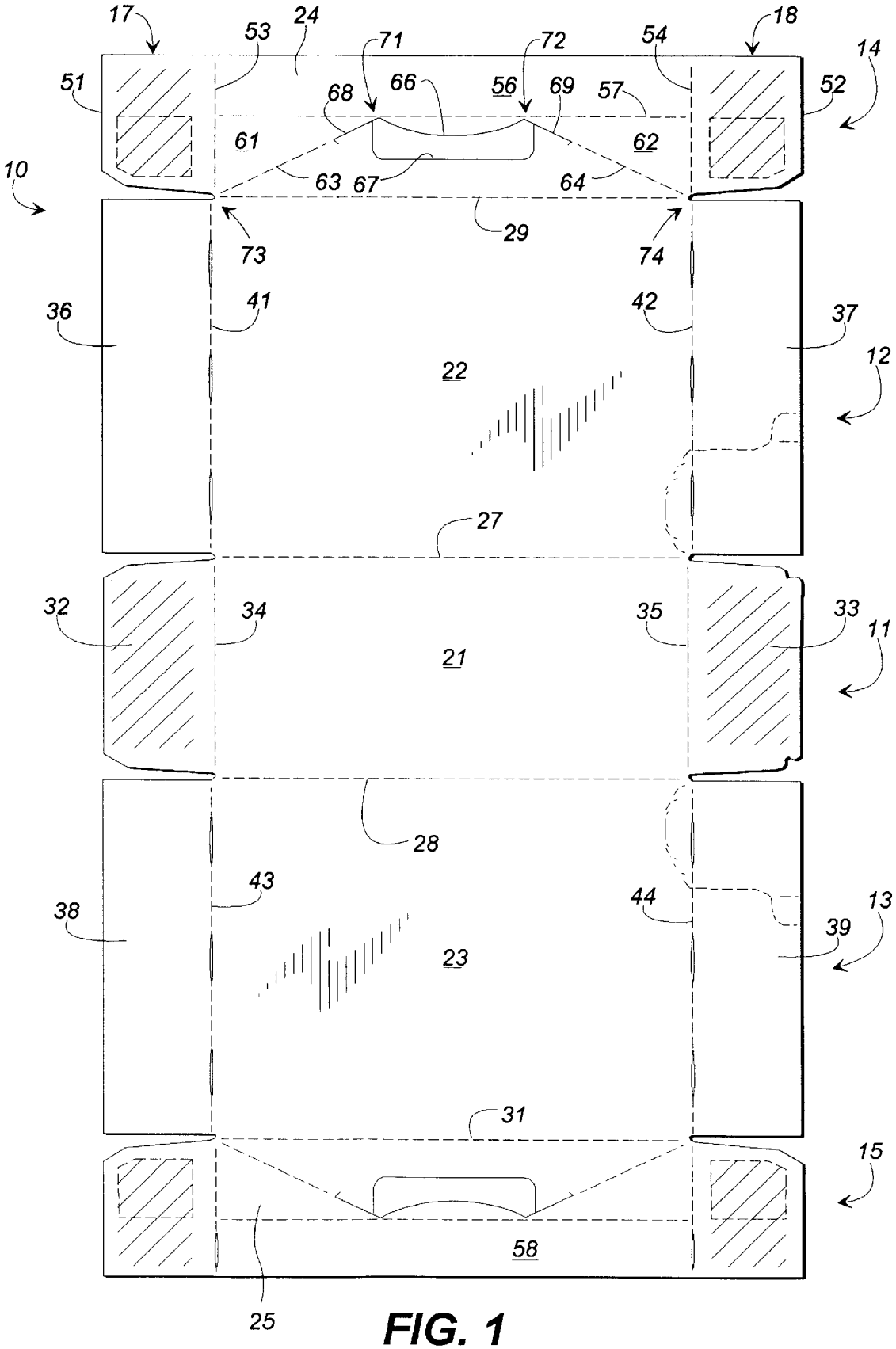
FIG. 1 is a plan view of a carton blank for forming a carton according to a preferred form of the invention.

Referring now in detail to the drawing figures, wherein like reference numerals represent like parts throughout the several views, FIG. 1 shows a carton blank 10 according to a preferred form of the invention. The carton blank 10 is provided for forming a carton having a 2-ply handle, as can be appreciated by those skilled in the art. The carton blank 10 is made of coated paperboard, the thickness (gauge) of which can be varied according to the number and size of the bottles or cans to be contained therein. However, generally speaking, the thickness of the carton blank 10 can be substantially reduced from prior art designs by virtue of the controlled tearing provided by the invention. Generally speaking, the thickness of the carton blank 10 according to the invention is in the range of 0.015–0.025". As mentioned above, where for example a prior art design might require a paperboard thickness of 0.021", the present invention allows a paperboard thickness of 0.018", a significant improvement.

The carton blank 10 includes a bottom section 11 and side sections 12 and 13 flanking the bottom section. Top sections 14 and 15 flank the side sections 12 and 13 respectively. The carton blank 10 also includes end flap sections 17 and 18.

The carton blank 10 includes a bottom panel 21 and side panels 22 and 23 connected to and flanking the bottom panel 21. Top flaps 24 and 25 are connected to and flank the side panels 22 and 23 respectively. Side panel 22 is foldably connected to bottom panel 21 along a score line 27, while side panel 23 is foldably connected to the other side of the bottom panel 21 along score line 28. Top flap 24 is foldably connected to side panel 22 along score line 29, while top flap 25 is foldably connected to side panel 23 along score line 31.

Bottom end flaps (glue flaps) 32 and 33 are foldably connected to opposite ends of the bottom panel 21 along score lines 34 and 35. Major end flaps 36–39 are foldably attached to the side panels 22 and 23 along perforated score lines 41–44. The perforated score lines 41–44 are positioned slightly outboard of score lines 34 and 35 and are parallel to the longitudinal direction of the carton blank.

The top section 14 also includes glue flaps 51 and 52 and an elongate handle strip 56 which extends from fold line 53 to opposite fold line 54 and is delineated by score line 57. It will be appreciated by those skilled in the art that top panel 25 is a mirror image of top panel 24; therefore discussion of the elements of top panel 24 should be sufficient for an understanding of the elements of top panel 25.

Top flap 24 also includes gussets 61 and 62 delineated by oblique gusset score lines 63 and 64. The top flap 24 also includes a short handle flap 66 and a canoe-shaped hand grip opening 67. J-shaped tear control cuts 68 and 69 extend from the corners 71 and 72 of the canoe-shaped hand grip opening and extend diagonally toward corners 73 and 74 of the top flap 24. In this regard, the shank portions of the J-shaped cuts 68 and 69 are aligned with score lines 63 and 64. The hook portions or terminus portions of the J-shaped cuts are curved (with a ⅛" diameter radius) and lead away from the elongate handle strip 56. In this regard, any tearing that tends to take place in the vicinity of the handle as the handle is grasped to lift the carton tends to be directed away from the handle and toward the score line 29.

In this way, tears are prevented from forming across the handle strip 56 and from being formed across gusset 61. Thus, the ability of the handle to carry the carton is not compromised or destroyed due to uncontrolled tearing. This allows the carton to be made of thinner paperboard. For ease of illustration the J-shaped cuts have been depicted as continuous. In the commercial embodiment, however, the J-shaped tear control cuts in the blank are left with small, spaced-apart nicks of paperboard in order to help keep the top panel flat until the handle is grasped to carry a filled carton. At that point, the very small nicks give way.

Figure 2:
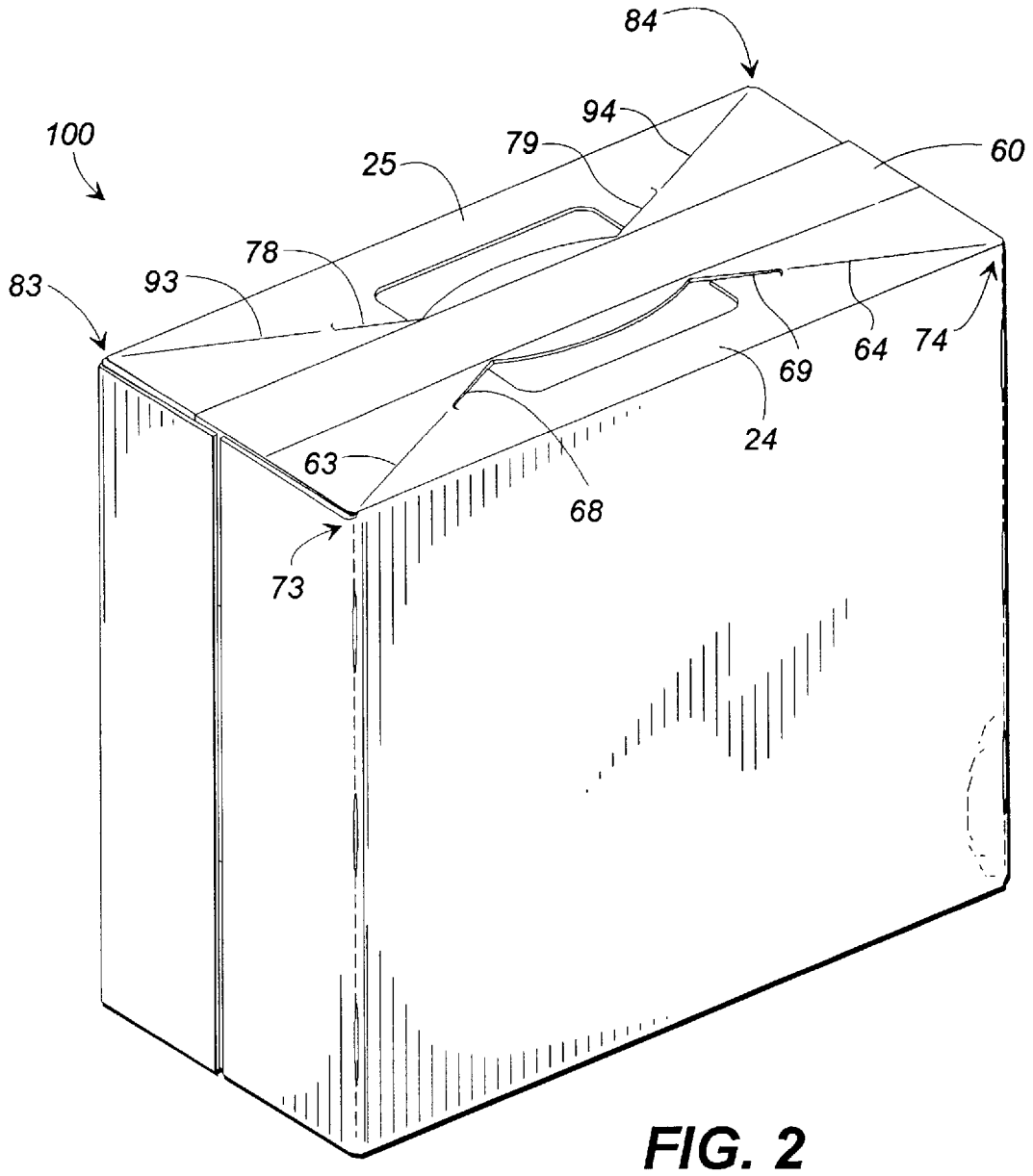
FIG. 2 is a perspective illustration of a carton formed from the carton blank of FIG. 1.

To turn the carton blank 10 of FIG. 1 into the carton 100 of FIG. 2, the carton blank is folded about the various score lines and is folded about the articles to be contained therein, according to techniques that are well-known in the industry. The top panel 24 ultimately overlaps top panel 25 by the width of the elongate handle strip 56. In this regard, top panel 25 has a corresponding elongate handle strip 58 and the two are glued together to form a strong, 2-ply handle. The handle is depicted in FIG. 2 as handle 60.

As shown in FIG. 2, the J-shaped tear control cuts 68, 69, 78 and 79 extend from the canoe-shaped handle openings toward the comers 73, 74, 83 and 84 of the top of the carton. As is also shown FIG. 2, the shank portions of the J-shaped tear control cuts are substantially aligned with the oblique gusset score lines 63, 64, 93 and 94. Moreover, all of the curved ends or hook portions of the J-shaped tear control cuts point away from the handle 60 toward the upper side edges of the carton 100.

Figure 3:
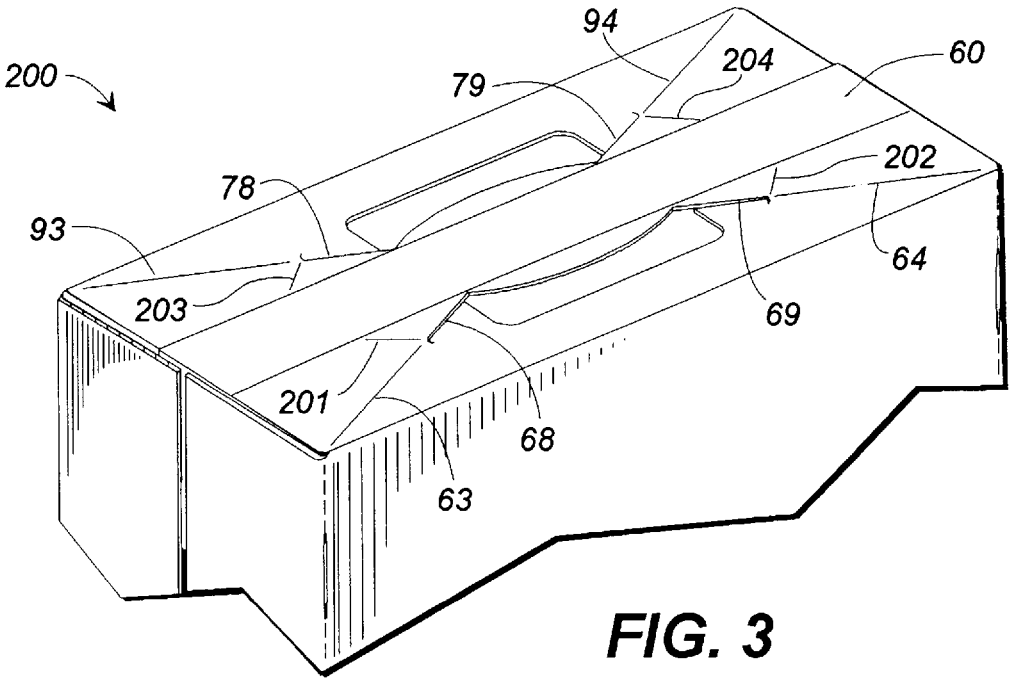
FIG. 3 is a perspective illustration of a portion of a carton according to a modified form of the invention.

FIG. 3 shows a similar arrangement to that of FIGS. 1 and 2. The carton 200 depicted in FIG. 3 is substantially identical to that of FIG. 2, with the notable addition of secondary oblique score lines 201–204 extending at an oblique angle between the edges of the 2-ply handle 60 and the point where the J-shaped tear control cuts 68, 69, 78 and 79 nearly touch the oblique gusset score lines 63, 64, 93 and 94. This provides additional strength for the gussets.

Figure 4:
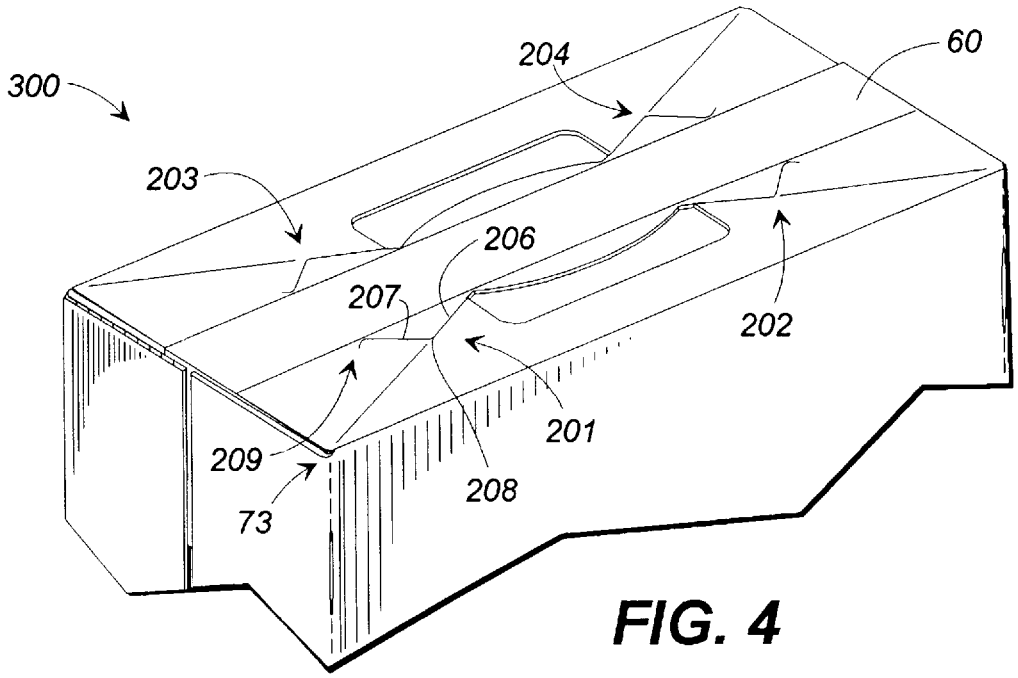
FIG. 4 is a perspective illustration of a portion of a carton according to another modified form of the invention.

FIG. 4 shows another arrangement which is also very similar to that of FIGS. 1 and 2. However, in the carton 300 depicted in FIG. 4, the J-shaped cuts have been replaced with wavy shaped cuts 201–204. Each of these has a first shank portion, such as shank portion 206, extending from a comer of the hand grip openings toward a corner of the top. Each also includes a second shank portion 207 which is transverse to the first shank portion and is directed back toward the 2-ply handle 60. At the transition 208 between the two shank portions 206, 207, a ⅛" radius preferably is utilized. At the distal end of the second shank portion 207, a hook portion 209 is provided. Preferably, the hook portion 209 includes the curve with a radius of ⅛" and the tip of the hook points towards one of the corners of the top, such as corner 73. The net effect of the change from what is shown in FIG. 2 to what is shown is FIG. 4 is to move the tear point for the top closer to the ends of the carton 300.

Figure 5:
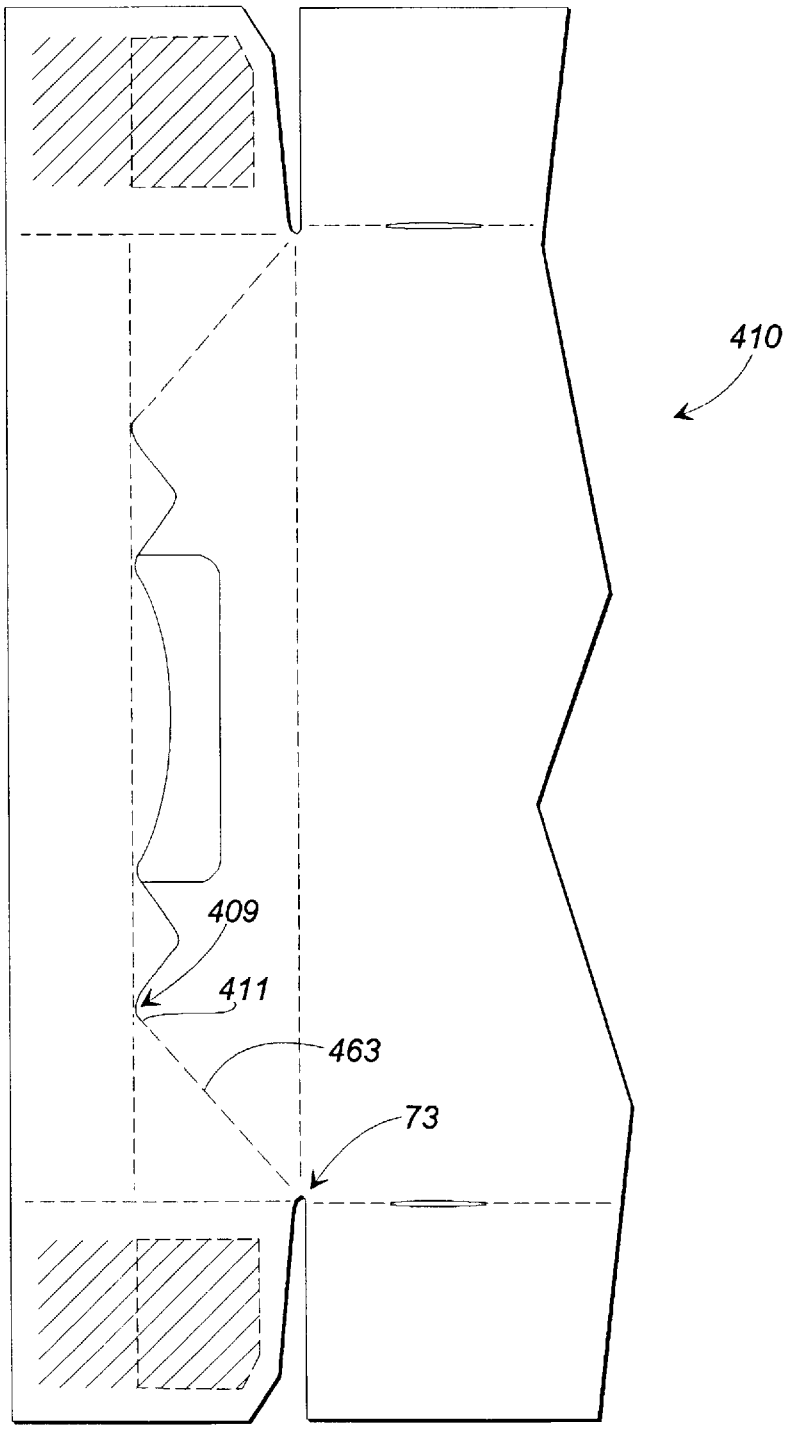
FIG. 5 is a plan view of a portion of a carton blank according to another preferred form of the invention.

FIG. 5 shows a portion of a carton blank for 10 according to another preferred form of the invention. In this preferred form, the wavy form of the tear control cuts is retained from the embodiment of FIG. 4 (for the most part). However, the hook portion 409 has a smaller radius of curvature, here 1/16". Moreover, a very short shank portion 411 extends from the end of the curved section and is aligned with the corner 73 of the top. This short shank portion 411 has a length preferably of approximately ⅛". The shank portion 411 is aligned with an oblique gusset score line 463 extending between the shank 411 and the comer 73.

In the evaluation of prototypes of the various embodiments discussed above, it is considered that, although the embodiments of FIGS. 1–4 provide excellent performance, the embodiment of FIG. 5 provides slightly improved performance over the other embodiments described herein.

While the invention has been disclosed in preferred forms, it will be apparent to those skilled in the art that many additions, deletions, and modifications can be made therein without departing from the spirit and scope of the invention as set forth in the following claims.

What is claimed is:

1. A carton comprising:

a bottom panel;

first and second side panels connected to said bottom panel;

first and second ends;

a top including a multi-ply handle section, said top being foldably connected to said first and second side panels and extending from said first end to said second end, said top including first and second hand openings defining a central hand grip therebetween; and wherein said top further comprises a plurality of tear control cuts extending outwardly away from adjacent said central hand grip.

2. A carton as claimed in claim 1 wherein said tear control cuts are each J-shaped and lead substantially away from said multi-ply section.

3. A carton as claimed in claim 2 wherein said J-shaped tear control cuts each include a shank portion and a hook portion and wherein said hook portions each point substantially away from said multi-ply section.

4. A carton as claimed in claim 3 wherein said shank portions are each substantially aligned with a corner of said top.

5. A carton as claimed in claim 1 wherein said top includes diagonal score lines defining lateral gussets flanking said multi-ply section adjacent said first and second ends.

6. A carton as claimed in claim 5 wherein said diagonal score lines are generally aligned with said tear control cuts.

7. A carton as claimed in claim 6 further comprising secondary oblique score lines extending from adjacent said multi-ply section to adjacent said diagonal score lines.

8. A carton as claimed in claim 1 wherein said tear control cuts each extend substantially diagonally outwardly away from said central hand grip.

9. A carton as claimed in claim 1 wherein said tear control cuts each includes a first portion which extends substantially diagonally outwardly away from said central hand grip.

10. A carton as claimed in claim 9 wherein said tear control cuts each includes a second portion which extends generally toward a corner of said top.

11. A carton as claimed in claim 10 further comprising diagonal score lines extending from adjacent said first portion to adjacent corners of said top.

12. A carton as claimed in claim 10 further comprising diagonal score lines extending from adjacent said second portion to adjacent corners of said top.

13. A carton comprising:

a bottom;

first and second sides extending from said bottom;

first and second ends opposite each other and adjacent said first and second sides;

a top including a multi-ply handle section, said top being foldably connected to said first and second sides and extending from said first end to said second end, said top including a central hand grip portion and wherein said top further includes at least two tear control cuts extending substantially diagonally outwardly from adjacent said central hand grip toward corners of said top, said tear control cuts each including a shank portion which extends diagonally toward one of said corners and a transverse portion which extends generally transversely from said diagonal portion and generally away from said multi-ply handle section.

14. A carton comprising:

a bottom;

first and second sides connected to and extending from said bottom;

first and second ends adjacent said first and second sides;

a top adjacent and connected to said first and second sides, said top including a multi-ply handle extending from said first end to said second end, said multi-ply handle including a central hand grip portion and a plurality of tear control cuts each beginning generally adjacent said central hand grip and extending away therefrom, said tear control cuts each having a terminus leading away from said multi-ply handle and toward one of said first and second sides.

* * * * *